US007270292B2

(12) United States Patent
Rasmussen

(10) Patent No.: US 7,270,292 B2
(45) Date of Patent: Sep. 18, 2007

(54) WEB TRANSFER MECHANISM FOR FLEXIBLE SHEET DISPENSER

(75) Inventor: Holger Rasmussen, Kilchberg (CH)

(73) Assignee: Georgia-Pacific Consumer Operations LLC, Atlanta, GA (US)

( * ) Notice: Subject to any disclaimer, the term of this patent is extended or adjusted under 35 U.S.C. 154(b) by 63 days.

(21) Appl. No.: 10/976,867

(22) Filed: Nov. 1, 2004

(65) Prior Publication Data

US 2005/0056721 A1 Mar. 17, 2005

Related U.S. Application Data

(62) Division of application No. 09/435,718, filed on Nov. 8, 1999, now Pat. No. 6,826,991.

(51) Int. Cl.
*B65H 19/00* (2006.01)

(52) U.S. Cl. ..... 242/560.1

(58) Field of Classification Search ..... 242/560, 242/560.1, 564.4; 312/34.22
See application file for complete search history.

(56) References Cited

U.S. PATENT DOCUMENTS

| | | | |
|---|---|---|---|
| 2,930,663 | A | 3/1960 | Weiss |
| 2,930,664 | A | 3/1960 | Liebisch |
| 3,007,650 | A | 11/1961 | Burton |
| 3,269,592 | A | 8/1966 | Slye et al. |
| 3,288,387 | A | 11/1966 | Craven, Jr. |
| 3,628,743 | A | 12/1971 | Bastian et al. |
| 3,858,951 | A | 1/1975 | Rasmussen |
| 3,917,191 | A | 11/1975 | Graham, Jr. et al. |
| 4,010,909 | A | 3/1977 | Bastian |
| 4,067,509 | A | 1/1978 | Graham et al. |
| 4,106,684 | A | 8/1978 | Hartbauer et al. |
| 4,148,442 | A | 4/1979 | Baumann et al. |
| 4,165,138 | A | 8/1979 | Hedge et al. |
| 4,317,547 | A | 3/1982 | Graham et al. |
| 4,358,169 | A | 11/1982 | Filipowicz et al. |
| 4,378,912 | A | 4/1983 | Perrin et al. |
| 4,396,163 | A | 8/1983 | Graham et al. |
| 4,403,748 | A | 9/1983 | Cornell |
| 4,487,375 | A | 12/1984 | Rasmussen et al. |
| 4,611,768 | A | 9/1986 | Voss et al. |

(Continued)

FOREIGN PATENT DOCUMENTS

| | | | |
|---|---|---|---|
| FR | 2583729 | A | 12/1986 |

(Continued)

*Primary Examiner*—John Q. Nguyen
(74) *Attorney, Agent, or Firm*—Joel T. Charlton

(57) ABSTRACT

An automatic web transfer mechanism in a flexible sheet material dispenser includes a web-sensing member operatively coupled with a transfer arm. The member senses the absence of web from a stub roll at a pre-feed portion between the stub roll and a feed roll nip to activate a transfer of feed to the web of a reserve roll. The transfer is initiated by a transfer arm that advances the reserve web into the proximity of the feed roller nip. In a second aspect, a movable front shield opens automatically upon opening of the outer dispenser cover, presenting an opening for pre-transfer placement and retention of a leading edge of web material from the reserve roll. Upon closure of the dispenser cover, the front shield returns to a closed position placing the transfer arm in a pre-transfer set position.

5 Claims, 8 Drawing Sheets

U.S. PATENT DOCUMENTS

| | | | |
|---|---|---|---|
| 4,712,461 | A | 12/1987 | Rasmussen |
| 4,756,485 | A | 7/1988 | Bastian et al. |
| 4,807,824 | A | 2/1989 | Gains et al. |
| 4,846,412 | A | 7/1989 | Morand |
| 5,244,161 | A | 9/1993 | Wirtz-Odenthal |
| 5,294,192 | A | 3/1994 | Omdoll et al. |
| 5,302,167 | A | 4/1994 | Kley et al. |
| 5,400,982 | A | 3/1995 | Collins |
| 5,526,973 | A | 6/1996 | Boone et al. |
| 5,558,302 | A | 9/1996 | Jesperson |
| 5,772,291 | A | 6/1998 | Byrd et al. |
| 6,354,533 | B1 | 3/2002 | Jespersen |
| 6,363,824 | B1 | 4/2002 | Granger |

FOREIGN PATENT DOCUMENTS

| | | | |
|---|---|---|---|
| FR | 2746621 | | 10/1997 |
| FR | 2746621 | A | 10/1997 |
| FR | 2771620 | A | 6/1999 |
| GB | 2267271 | A | 12/1993 |

WEB TRANSFER MECHANISM FOR FLEXIBLE SHEET DISPENSER

BACKGROUND OF THE INVENTION

This application is a divisional application of U.S. application Ser. No. 09/435,718, filed Nov. 8, 1999 now U.S. Pat. No. 6,826,991.

The present invention relates to flexible sheet dispensers for sequentially dispensing a web of material from a plurality of rolls, and in particular to an automatic transfer mechanism for transferring the feed supply from a working roll to a reserve roll, upon exhaustion of the working roll.

Dispensers for toweling are primarily designed to dispense either a continuous length of web material, folded paper towels, or rolls of paper towels. Continuous towels are generally made of a reusable material and form a towel loop outside of the dispenser cabinet for the consumer to use. Folded towels are paper towels which are pre-cut and folded into various configurations to be individually dispensed for use. Roll towels are continuous rolls of paper toweling which are typically wound around a cardboard core and which are, upon dispensing, separated into and delivered as individual lengths of material.

Continuous web dispensers, such as those disclosed in U.S. Pat. No. 2,930,663 to Weiss and U.S. Pat. No. 3,858,951 to Rasmussen, require the user to pull on the loop of exposed toweling in order to cause a length of clean toweling to be dispensed and the exposed soiled toweling to be correspondingly taken up within the dispenser. Although economical, the continuous exposure of the soiled toweling is deemed unsightly, and therefore unacceptable to many consumers when compared to many available alternatives. Further, the exposure and possible reuse of soiled toweling may present additional health hazards and sanitation and hygiene concerns which should be avoided.

The use of either interfolded paper towels or C-fold paper towels eliminates some of the potential health risks associated with continuous web toweling. Dispensers for folded paper towels allow a user to pull the exposed end of a new individual towel in order to dispense the towel. These dispensers, such as the one disclosed in U.S. Pat. No. 3,269,592 to Slye et al., are also easy to refill with folded towels. That is, when the dispenser is partially empty, the cover can simply be removed and the remaining stack of towels can be replenished through the open top. Folded towels are, however, not usually the most economical alternative for institutional and other high-volume situations due to the uncontrolled dispensation of toweling.

Roll towels are cheaper to manufacture than folded towels and also eliminate the potential health and sanitation problems associated with continuous web toweling systems. Dispensers for roll towels usually include a lever, crank, or other user-activated mechanism for dispensing a length of towel. An effective and popular style roll towel dispenser is disclosed in commonly owned U.S. Pat. No. 4,712,461 to the present inventor. The '461 patent teaches the use of a blade that is cam actuated from within a feed roller to sever lengths of towel from the roll. In contrast to folded towel dispensers, it is not a straight forward matter to replenish a partially depleted supply of web material in a roll dispenser. If a new roll is substituted for a partially depleted or "stub" roll which is thrown away, substantial waste of material can result. If waste is avoided by letting the stub roll become completely depleted, then the dispenser may sit empty for some time before the roll is replaced, thereby causing inconvenience to users.

To overcome the problem of stub roll waste, roll dispensers have been designed to dispense two rolls of web material sequentially such that upon depletion of a primary roll, feeding from a reserve roll is commenced. Prior art systems have accomplished this transfer by either modifying the end of the web material or modifying the roll core upon which the web material is wound, such as in the system disclosed in U.S. Pat. No. 3,288,387 to Craven, Jr. Alternatively, the system of U.S. Pat. No. 3,628,743 to Bastian et al. senses the diameter of the primary roll in order to activate the transfer to the reserve roll, and the system of U.S. Pat. No. 3,917,191 to Graham, Jr. et al. senses the tension in the primary roll in order to detect when it is nearly exhausted. Unfortunately, tension responsive transfers are not particularly reliable since conditions other than reaching the end of the roll can trigger their operation, such as the slackening of the web or a break in the web material. Diameter responsive transfers also have a drawback in that the reserve web begins dispensing prior to the complete exhaustion of the primary roll. Thus, for at least a short time web material is dispensed simultaneously from both rolls, and again a waste of material results.

To overcome these disadvantages, the systems of U.S. Pat. No. 4,165,138 to Hedge et al. and U.S. Pat. No. 4,378,912 to Perrin et al. provide a transfer mechanism which senses the absence or presence of paper around a grooved feed roll by using a sensing finger which rides along the top surface of the web material and which then drops down into the groove in the feed roll when the trailing end of the primary web has passed thereover and thus uncovers the groove. Responsive to the movement of the sensing finger into the groove, the reserve web is introduced into the feed nip between the feed rolls and dispensing from the reserve roll begins. This type of transfer mechanism generally eliminates the false transfer associated with tension responsive systems, and reduces the amount of double sheet dispensing which occurs in other prior art diameter and end of roll responsive systems.

However, the use of sensing fingers riding on the web material can, depending on the design, produce extra friction which can inadvertently tear the web. Also, the introduction of additional components to sense the absence of the web and transfer the reserve web into the feed nip between the feed rollers creates additional opportunities for a transfer failure or interference with web feed to occur. In particular, in each of the designs of the Hedge et al. and Perrin et al. patents, a tucking device (blade or roll) is used. The device pivots into close proximity to the feed nip, and remains there through subsequent dispensing from the reserve roll. It is evident that interference with the web feed from the reserve roll could result if proper positioning of the transfer device, away from the nip, is not maintained.

A need has therefore existed for a flexible sheet dispenser having an automatic transfer mechanism which, in addition to eliminating or reducing simultaneous dispensing from two rolls, requires few additional parts within the dispenser and which is not prone to interference with the proper dispensing of web material. A transfer mechanism that, to a large extent, fulfills this need is described in commonly assigned U.S. Pat. No. 5,526,973 to Boone et al. Therein, movement and interengagement of one grooved feed roller relative to the other, upon depletion of a stub roll, actuates a transfer mechanism that introduces a reserve web into the feed nip. While generally quite effective, the movement and spring biasing of a relatively high mass feed roller can lead to difficulties. The feed roller spring bias force must be within a relatively narrow window. If the spring bias is set too high, the biasing force may inhibit smooth feeding of the web material through the rollers, and result in tearing of the web material. If it is set too low, the mechanism may not actuate effectively to cause a transfer of feed to the reserve roll immediately upon depletion of the stub roll. Over time, the spring bias provided to move one roll relative to the other is prone to eventually decrease, e.g., due to fatigue of the spring, such that ultimately the spring force may fall below the required relatively narrow range and thus be insufficient to properly actuate a web transfer.

Thus, there remained a need for an automatic web transfer mechanism that could provide increased reliability, robustness and cost effectiveness. A mechanism capable of delivering these characteristics is disclosed in commonly owned U.S. patent application Ser. No. 09/383,019 by Jespersen, filed Aug. 25, 1999, now U.S. Pat. No. 6,354,533. The sheet material dispenser disclosed in the Jespersen application uses a web transfer arm that remains positioned away from the feed path of the transferred web, to thus reduce the possibility of the transfer mechanism interfering with the web material as it is dispensed. The dispenser eliminates double sheet dispensing from the reserve and working rolls by sensing the presence or absence of the working web at the backside of the main feed roller.

Despite their benefits, the transfer mechanisms of the Boone et al. '973 patent and the Jespersen application are not well suited for providing a transfer of web feed in a dispenser with a feed mechanism incorporating an automatic cutting knife within the main feed roller. As mentioned above, commonly owned Rasmussen U.S. Pat. No. 4,712,461 teaches the use of a cam actuated cutting knife that progressively emerges from the feed roller as the roller rotates through a dispensing cycle. Use of a web sensor positioned against or near a feed roller having an integral web cutting knife, as taught in the '461 patent, would be problematic due to the emergence of the cutting knife as the feed roll rotates.

Dispensers embodying feed roller/cutter configurations in accordance with the Rasmussen '461 patent, such as the commercially available Georgia-Pacific P-12 dispenser, are popular, and large numbers are in use. To reduce material waste and associated costs, it would be highly desirable to provide a web transfer mechanism that may be manufactured as an adaption of, or retrofit to, these and like dispensers having a feed roller incorporated cutting knife, to thus provide a reliable and robust dispenser that combines effective web cutting and web feed transfer functionalities.

SUMMARY OF THE INVENTION

In view of the foregoing, it is a principal object of the present invention to provide a web transfer mechanism well suited for a flexible sheet dispenser having a feed roller incorporated web cutting device.

It is a more specific object of the invention to provide a web sensing mechanism located away from the feed roller, and which avoids substantial double-feed at the time of a web transfer (and consequent excessive waste of web material).

It is another specific object of the invention to provide a web transfer mechanism that may be implemented by adaption or retrofit of existing dispenser designs embodying a feed roller incorporated cutting device.

Another object of the present invention is to provide a web transfer mechanism with simple and intuitive loading/setting characteristics, to thereby permit simple, fool-proof dispenser maintenance by unskilled personnel.

These and other objects are achieved, in accordance with a first aspect of the present invention, by a web transfer mechanism for providing, in a flexible sheet material dispenser, automatic transfer of web feed from a working roll to a reserve roll. A main feed roller and a second roller form a feed nip for receiving therethrough a sheet material web. A sensing mechanism includes a sensor plate movable between a web-present position and a web-absent position. The sensor plate rests in the web-present position, on a pre-feed portion of sheet material web extending between the working roll and the nip, and is biased towards the web-absent position. A stop arm is mounted for movement between first and second positions, responsive to movement of the sensor plate. A transfer arm is mounted adjacent to the main feed roller. The transfer arm is biased toward and movable into a transfer position. Movement of the transfer arm into the transfer position is operative to drive a leading end portion of sheet material web extending from the reserve roll into the vicinity of the feed nip, such that upon driving of the main feed roller, the web from the reserve roll is carried through the feed nip. The transfer arm is held in a set position by the stop arm when the stop arm is in the first position. The transfer arm is released from the set position to move to the transfer position upon the stop arm moving into the second position.

A second aspect of the invention is also embodied in a web transfer mechanism for providing, in a flexible sheet material dispenser, automatic transfer of web feed from a working roll to a reserve roll. A main feed roller and a second roller form a feed nip for receiving therethrough a sheet material web. A transfer arm is mounted adjacent to the main feed roller. The transfer arm is movable into a transfer position. Movement of the transfer arm into the transfer position is operative to drive a leading end portion of sheet material web extending from the reserve roll into the vicinity of the nip such that upon driving of the main feed roller the web from the reserve roll is carried through the nip. A dispenser cover member and a movable shield member are provided. The shield member is biased to move into an open position automatically when the cover member is moved to an open position. The shield member presents, when in its open position, a space for placement and retention of the leading end portion of sheet material web between the transfer arm and main feed roller, to thereby pre-set the leading end portion for a subsequent transfer of feed thereto.

The above and other objects, features and advantages of the present invention will be readily apparent and fully understood from the following detailed description of preferred embodiments, taken in connection with the appended drawings.

DETAILED DESCRIPTION OF THE PREFERRED EMBODIMENTS

Figure 1:
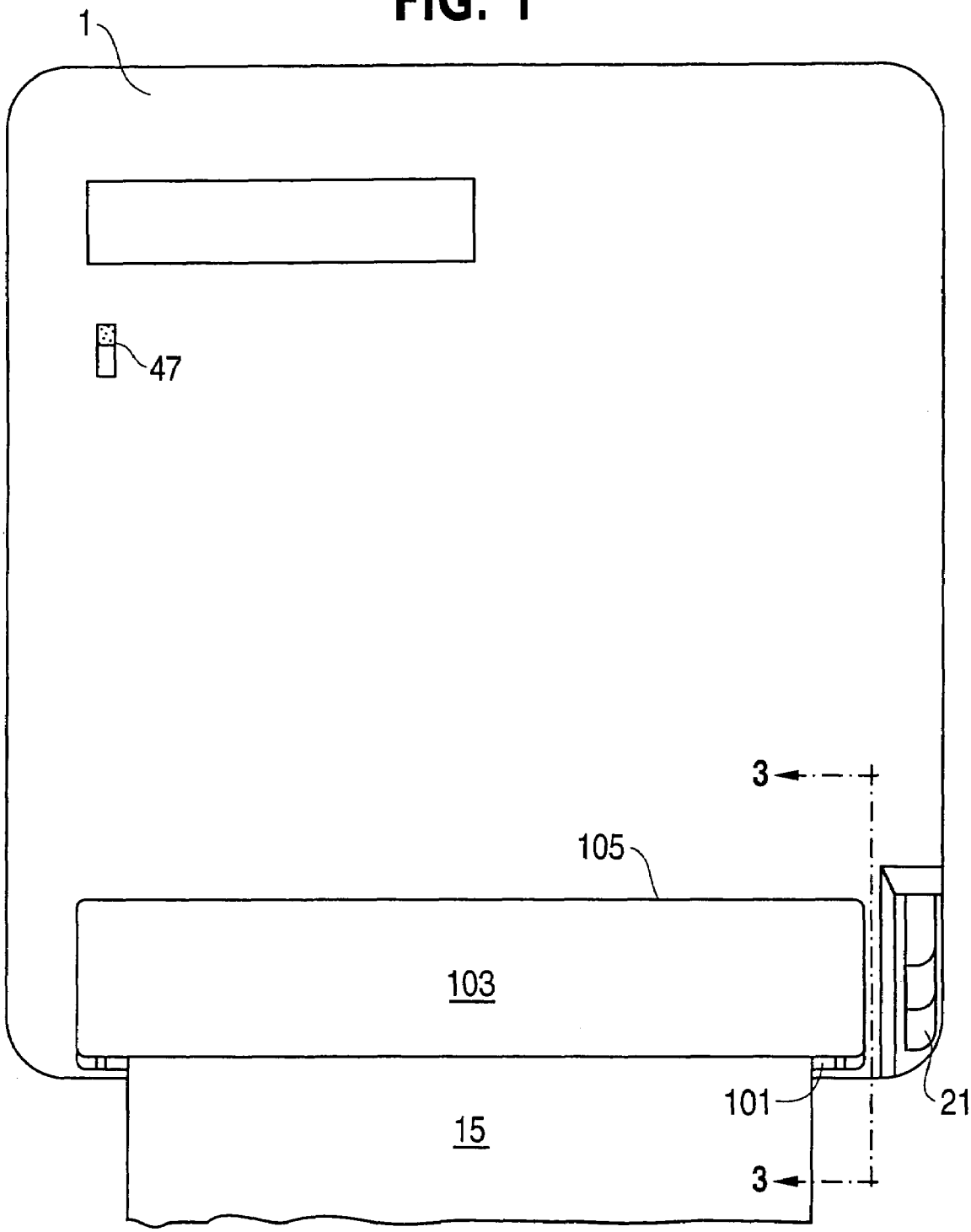
FIG. 1 is a front elevational view of a sheet material dispenser embodying a web transfer mechanism in accordance with the present invention.
Figure 2:
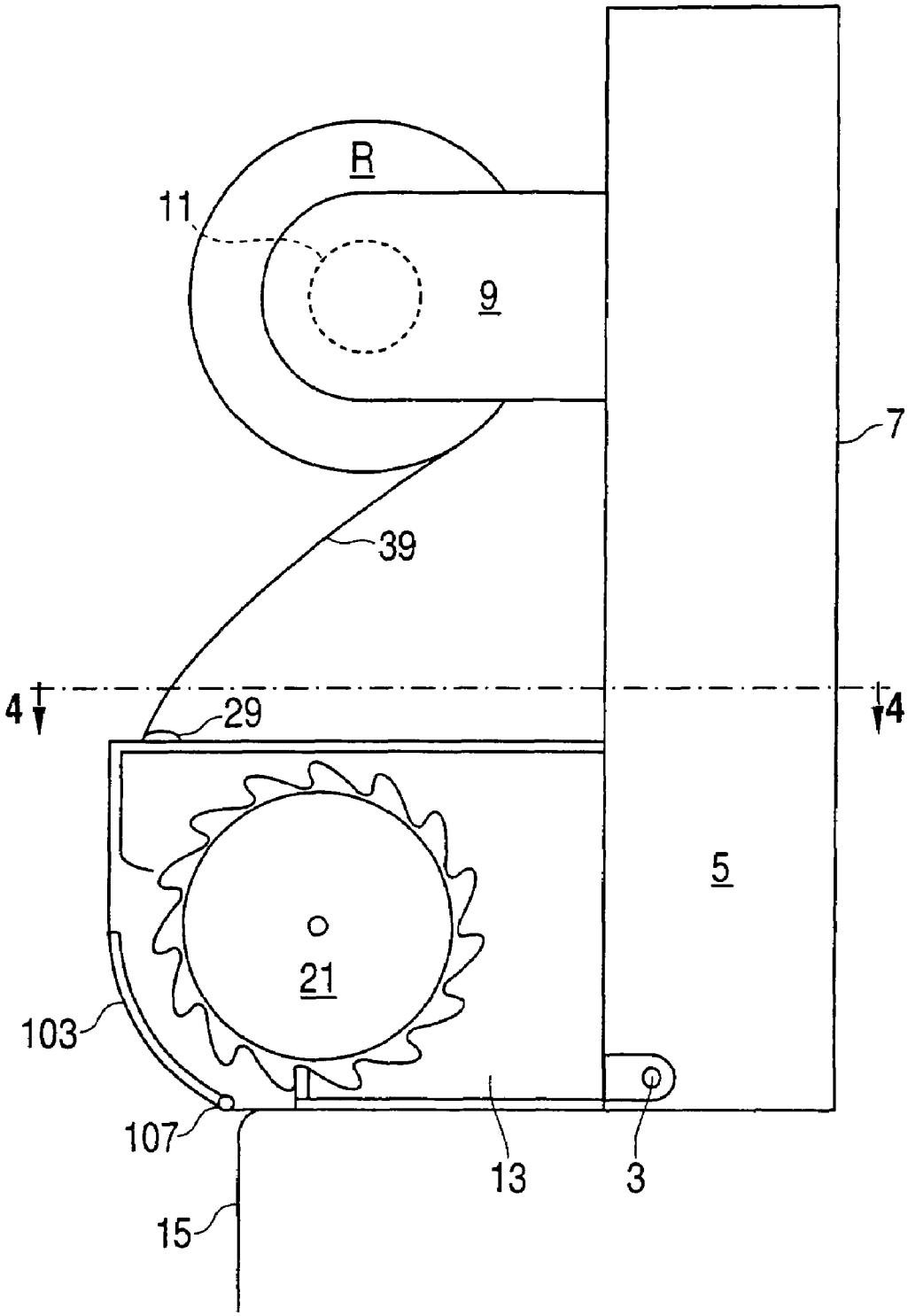
FIG. 2 is a left-end elevational view of the dispenser shown in FIG. 1, with a front cover of the dispenser removed.

Referring to FIGS. 1 and 2, it is seen that a dispenser in accordance with the present invention may employ a generally conventional-style exterior dispenser cabinet, e.g., the type used in the commercially available Georgia-Pacific P-12 dispenser. The cabinet shown includes a five-sided cover 1 that is pivotally mounted, at a pivot point 3 (see FIG. 2), to a relatively shallow tray-like base member 5. Base member 5 has a back wall 7 with appropriate openings (not shown) to accommodate fasteners for attachment of the dispenser to a wall.

A reserve roll R of flexible sheet material, such as paper toweling, may be suitably supported between a pair of cantilever mounted wing members 9 extending from the inside surface of back wall 7. Each wing member carries a cup 11 at its free end, which enters into the opposite ends of the core of reserve roll R. The mounting of reserve roll R within the dispenser housing is conventional, and thus no further discussion of this structure is required. Additional generally well known features of the dispenser include a lower chassis comprising a pair of side plates 13 extending from back wall 7 along the opposite sides of the dispenser in a lower part thereof. Side plates 13 serve to provide rotatable mounting locations for the feed rollers and other operative components of the dispenser, to be described.

Figure 3:
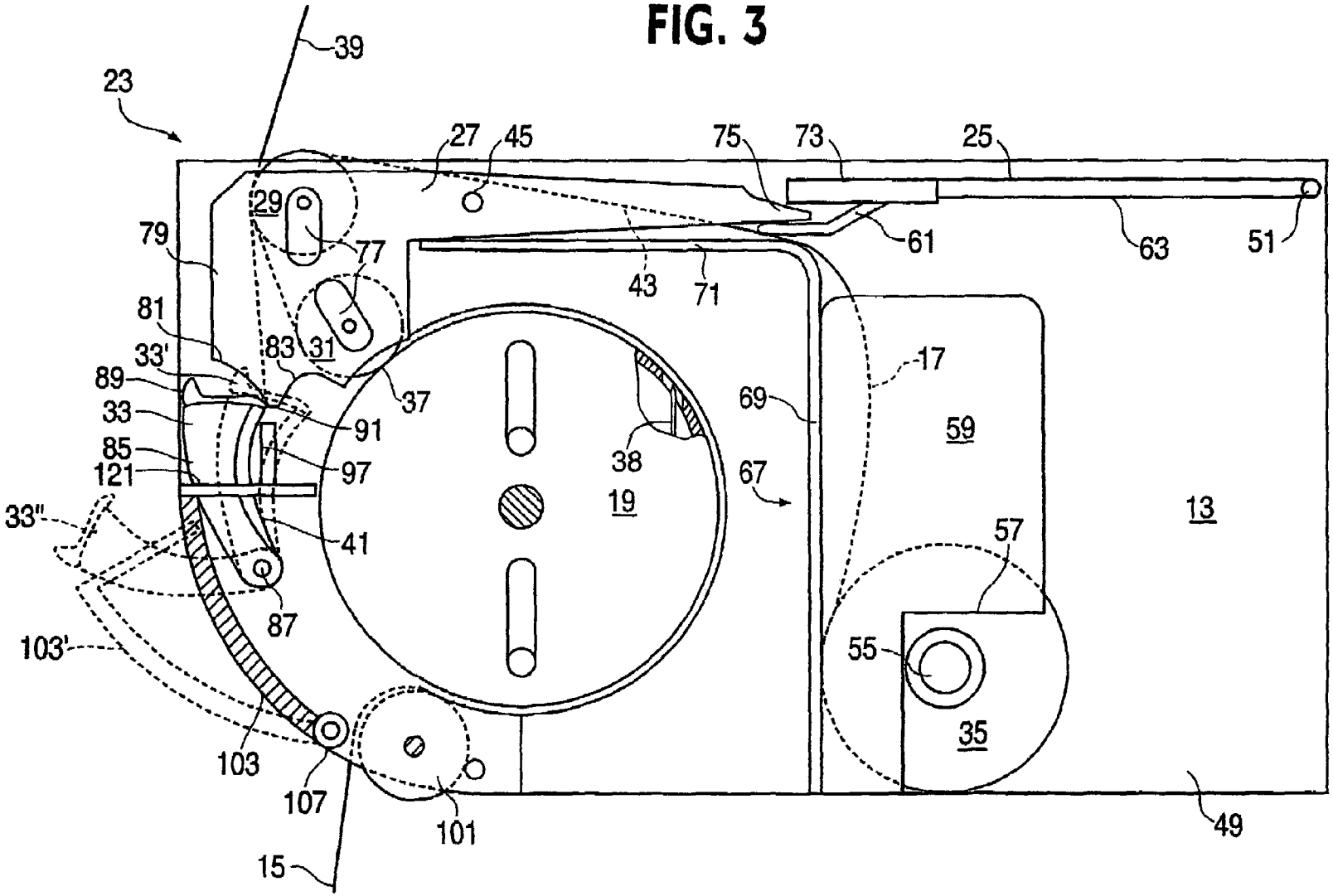
FIG. 3 is an enlarged sectional view taken on line 3-3 in FIG. 1, showing a lower portion of the dispenser (dispenser cover removed) including the web transfer mechanism.
Figure 4:
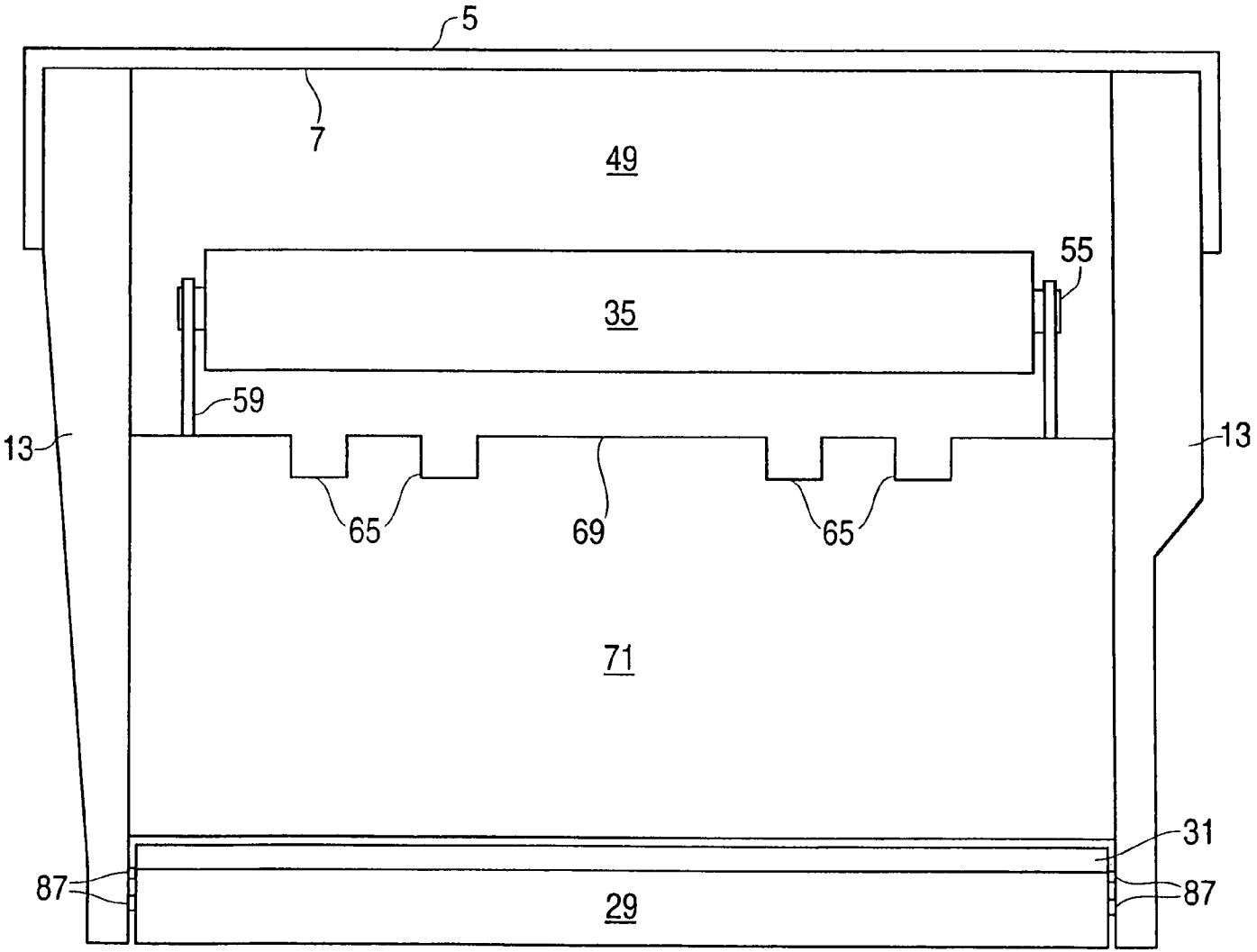
FIG. 4 is a sectional view taken on line 4-4 in FIG. 2, showing the lower portion of the dispenser seen in FIG. 3, with a sensor plate of the web transfer mechanism removed to reveal a stub-roll receptacle.

Preferably, as in the commercially available Georgia-Pacific P-12 dispenser, web material is dispensed in response to a pulling force (tension) being exerted on an exposed free end 15 of a working web 17 (see FIG. 3). Pulling of free web end 15 induces main feed roller 19 (see FIG. 3) to rotate a predetermined amount, and a sheet segment of predetermined length to be dispensed and cut by a feed roller mounted, cam actuated, knife 38 of the type disclosed in Rasmussen U.S. Pat. No. 4,712,461 (hereby incorporated by reference in its entirety). Web material may alternatively be dispensed by rotating a known-type ratchet wheel 21 by hand. The web transfer mechanism of the present invention is also useable with various other web feed/cutting mechanisms known in the art.

A web transfer mechanism 23 in accordance with the present invention is seen clearly in FIG. 3 and includes a pivotable sensor plate 25, a pivotable stop arm 27, a pair of idler rollers 29 and 31, main feed roller 19 and a rotatable transfer arm 33. In operation, working web 17 comes-off of a working (stub) roll 35 and follows a path extending under sensor plate 25, around upper idler roller 29 and into a feed nip 37 formed between lower roller 31 and main feed roller 19. A reserve web 39 extends from reserve roll R (see FIG. 2), over roller 29 (in light contact with working web 17), and terminates with a free end 41 positioned in a space defined between main feed roller 19 and rotatable transfer arm 33. A pre-feed portion of the working web path 43, spaced away from (behind and above) feed roller 19, is where the presence or absence of web from working roll 35 is sensed.

As will be described in greater detail, when working roll 35 is completely depleted, a trailing edge of working web 17 passes out from under a forward edge of sensor plate 25. Sensor plate 25 is biased downwardly, preferably solely by gravity (alternatively or additionally by a spring), and pivots downwardly when freed to do so by an absence of web 17, to rotate stop arm 27 slightly clockwise about a pivot pin 45. Transfer arm 33 is biased to rotate clockwise towards nip 37 and does so when released from its set position, by the clockwise rotation of stop arm 27. As transfer arm 33 rotates to transfer position 33', it drives a free end portion of the reserve web 39 into or proximate nip 37, where reserve web 39 may be drawn through nip 37 upon subsequent driving of feed roller 19.

Working roll 35 originates as a reserve roll R that has been partially depleted after dispensing an amount of web material therefrom. The degree of depletion of reserve roll R may be visually monitored by opening cover member 1, or by a known type of indicator 47 on the front or side of cover member 1, such as a rotatable color bar or a transparent window. Upon partial depletion, reserve roll R (now a stub roll 35) is removed from between wing members 9 and replaced with a new reserve roll. The removed roll is placed in receptacle 49. Receptacle 49 is opened by lifting sensor plate 25, which forms a cover over receptacle 49, and working roll 35 is dropped into the receptacle to rest on the floor thereof. Sensor plate 25 is lifted by rotating sensor plate 25 about a pivot axis 51 defined between side plates 13, adjacent back wall 7. To facilitate this movement, a pair of finger grip holes 53 are provided in sensor plate 25 (see FIG. 5).

The lower chassis floor is cut-away (open) between side plates 13 in the region of receptacle 49. The floor of receptacle 49 is thus formed by the overlapping bottom panel of cover 1, when cover 1 is in its closed position.

The cores of the web rolls preferably comprise mounting spindles 55 that protrude from the opposite ends of the rolls, and which may become seated within a notch 57 provided in a pair of retaining members 59 provided within receptacle 49. As shown, retaining members 59 are thin notched plates fixed at their forward ends to a front wall of receptacle 49, and extending toward the rear of receptacle 49. Retaining members 59, with spindles 55, restrain working roll 35 as it is pulled upwards by tension in pre-feed web portion 43, to prevent working roll 35 from being drawn up from under sensor plate 25, especially as working roll 35 reaches the end of working web 17 (which may be glued to spindle 55).

Figure 5:
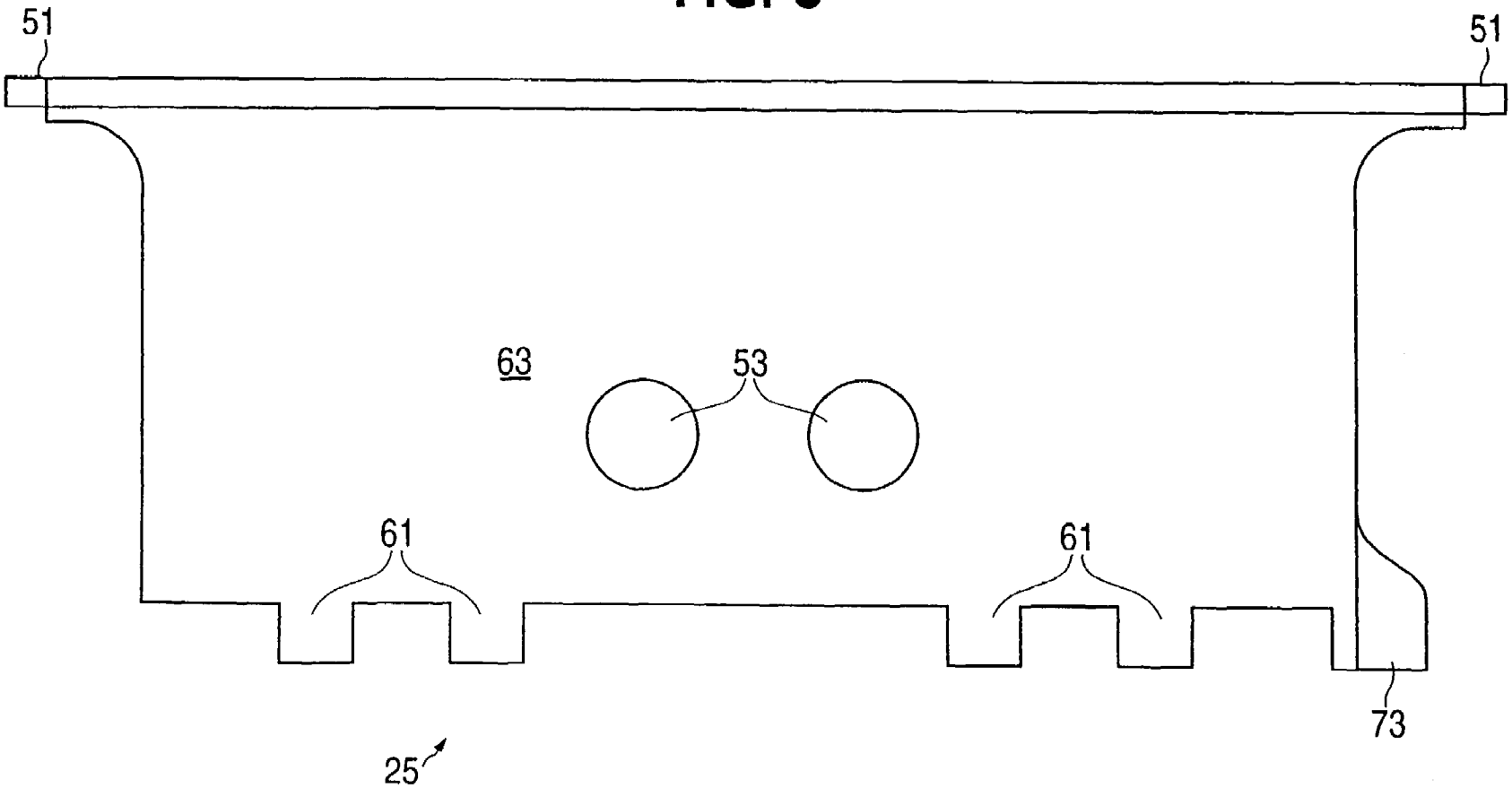
FIG. 5 is a top plan view of the sensor plate of the web transfer mechanism shown in FIG. 3 (and removed from FIG. 4).

The forward edge of sensor plate 25 includes a plurality of sensor fingers 61, as best seen in FIG. 5. Sensor fingers 61 extend outwards and downwards from a main panel 63 of sensor plate 25 to rest upon pre-feed portion 43 of the working web 17, in a web-present position. In a web-absent position, sensor plate 25, including fingers 61, is pivoted downwardly by gravity, with fingers 61 entering a plurality of slots 65. Slots 65 are correspondingly located in a generally inverted L-shaped casing member 67 surrounding rear and upper sides of feed roller 19, at the juncture between a vertical casing wall 69 (defining a front wall of receptacle 49), and an adjacent horizontal casing wall 71. Casing 67 serves to reinforce and laterally stabilize chassis side plates 13. In addition, casing 67 provides, on a side opposite receptacle 49, a plurality of arcuate ribs (not shown) defining an arcuate feed path about the rear side of feed roller 19.

Sensor plate 25 should be configured to provide a downward force of sensor fingers 61 sufficiently small to avoid interference with feeding of working web 17, e.g., to prevent ripping or tearing of pre-feed portion 43. On the other hand, the bias force of plate 25, e.g., the moment created by the distributed weight of the plate, must be sufficient to pivot and disengage stop arm 27. Using gravity to provide the downward bias of sensor plate 25 has the advantages of simplicity and constancy as compared to a spring which may suffer from fatigue. Bias of sensor plate 25 may also be bolstered or supplied using common spring designs. Spring bias would be especially desirable for possible alternative embodiments wherein sensor plate 25 is mounted to have an actuating movement lacking a downward component. The pivotal mount of sensor plate 25 adjacent rear wall 7 permits a relatively long lever arm and, since the plate can be readily pivoted to an open position, permits easy placement of a stub roll in receptacle 49.

A significant advantage of the inventive web transfer mechanism over previous designs is that sensor plate 25 senses the absence of web from working roll 35 at a pre-feed portion spaced sufficiently from the operation of feed roller 19 (and integral cutting knife) and rotatable transfer arm 33 to prevent malfunction and interference, yet close enough to feed roller 19 to minimize double feed of web at the time of transfer. In known dispensers that include a cutting knife which emerges from the main feed roller, such as the Georgia-Pacific P-12, a web sensor that senses the presence or absence of web material at the main feed roller would be prone to interfere with the feed roller incorporated knife as it emerges, resulting in a malfunction of one or both of the cutting knife and sensing mechanism. The present invention avoids this difficulty. Additionally, with the inventive arrangement, a proper threading of the web under the sensor plate is simple and not prone to faulty configuration, because the sensor plate 25 is necessarily raised to permit placement of a stub roll in receptacle 49. Plate 25 is automatically placed in a proper sensing position upon a closure of receptacle 49, by simply permitting plate 25 to drop into position.

Web transfer mechanism 23 of the present invention is well suited for (but not limited to) use in conjunction with a dispenser that includes a cutting blade mounted within a feed roller, such as is disclosed in the Rasmussen '464 patent, and embodied in the P-12 dispenser commercially available from Georgia-Pacific. In this type of dispenser, rotation of the feed roller through a dispensing cycle is initiated by a user pulling on the exposed leading end of web. The pulling of the web through one-half of a dispensing cycle loads a spring (not shown) which serves to carry the feed roller through the remainder of a dispensing cycle. A cutting blade is slidably mounted within the feed roller and progressively emerges from the feed roller in response to rotation of the feed roller. Extension of the cutting blade severs a length of web from the rolled material. The present web transfer mechanism is well suited for use with such dispensers because the sensor plate 25 is located at the pre-feed portion 43 of the working web 17 positioned away from feed roller 19 (and the cutting knife action). Also, the present invention may advantageously be adapted or retrofit to existing dispensers such as the Georgia Pacific P-12 dispenser, without the need to alter the configuration of main feed roller 19 and its cutting blade, as well as other components.

As seen in FIGS. 3 and 5, sensor plate 25 also includes a coupling tab or overhang 73 attached at a forward corner of main panel 63. Tab 73 extends forwardly so as to overlap with a rear coupling end 75 of stop arm 27. Coupling tab 73 may be of various sizes and shapes allowing it to push downwardly on coupling end 75. Once the trailing end of stub roll web 17 has passed over slots 65, the clockwise rotation of sensor plate 25, along with coupling tab 73, depresses stop arm 27 to rotate slightly counterclockwise from a hold position to a release position.

Figure 6:
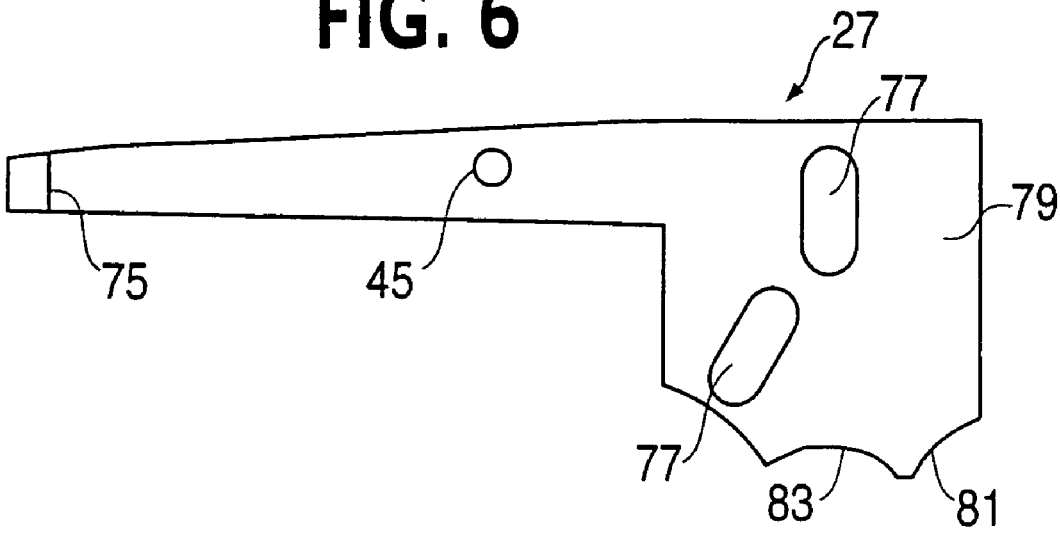
FIG. 6 is a side elevational view of a stop arm of the web transfer mechanism shown in FIG. 3.
Figure 7:
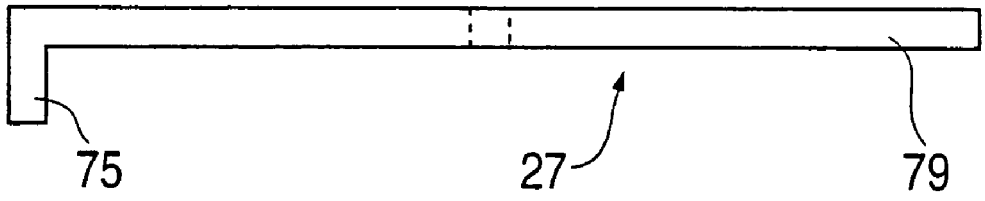
FIG. 7 is a top plan view of the stop arm shown in FIG. 6, but with elongated slots 77 not shown.

Stop arm 27 is preferably constructed of a thin plate having a generally mallet-like shape, as seen in FIGS. 3, 6 and 7. Coupling end 75 of arm 27 extends perpendicularly out of the plane of the remainder of stop arm 27 (see FIG. 7) and serves to engage the underside of coupling tab 73 of sensor plate 25. Formed in a "head" portion of the mallet-like shape of stop arm 27 are a pair of elongated slots 77 with rounded ends which are received on the axes of rollers 29 and 31, and which permit a limited range of pivotal motion of stop arm 27. Stop arm 27 is mounted adjacent left side plate 13, to which it is pivotably affixed by pin 45. Rollers 29 and 31 span the distance between the pair of side plates 13 and each has an axial shaft that fixes rollers 29 and 31 between side plates 13. Stop end 79 of stop arm 27 is fitted within a narrow clearance between the left ends of rollers 29 and 31, and the left side plate 13. Lateral motion of stop arm 27 is restrained within this narrow clearance. Slots 77 provide space for the movement of stop end 79 with respect to the axial shafts of each of rollers 29 and 31, and limit the amount of rotation about axis pin 45, thereby restraining the pivotable motion of stop arm 27.

Stop end 79 of stop arm 27 includes an arcuate edge surface 81 generally facing downward and outward of the dispenser. Edge surface 81 engages an opposing edge of rotatable transfer arm 33 when stop arm 27 is in the hold position. This engagement holds transfer arm 33 (against a spring bias thereof—to be described) in a set position until coupling end 75 of stop arm 27 is depressed by coupling tab 73 to pivot stop arm 27 slightly counterclockwise into the release position. In the release position, stop arm 27 has rotated slightly about the pivot axis defined by pin 45 in response to the downward motion of coupling tab 73, and stop end 79 has moved upward, causing disengagement from transfer arm 33. Arcuate edge surface 81 allows an opposing edge of transfer arm 33 to slide therealong until such point that a lower terminus of edge surface 81 is reached, at the tip of a lobe formed between arcuate edge surface 81 and a second arcuate edge surface 83, whereupon transfer arm 33 is released to move under spring bias into a transfer position 33'.

Figure 9:
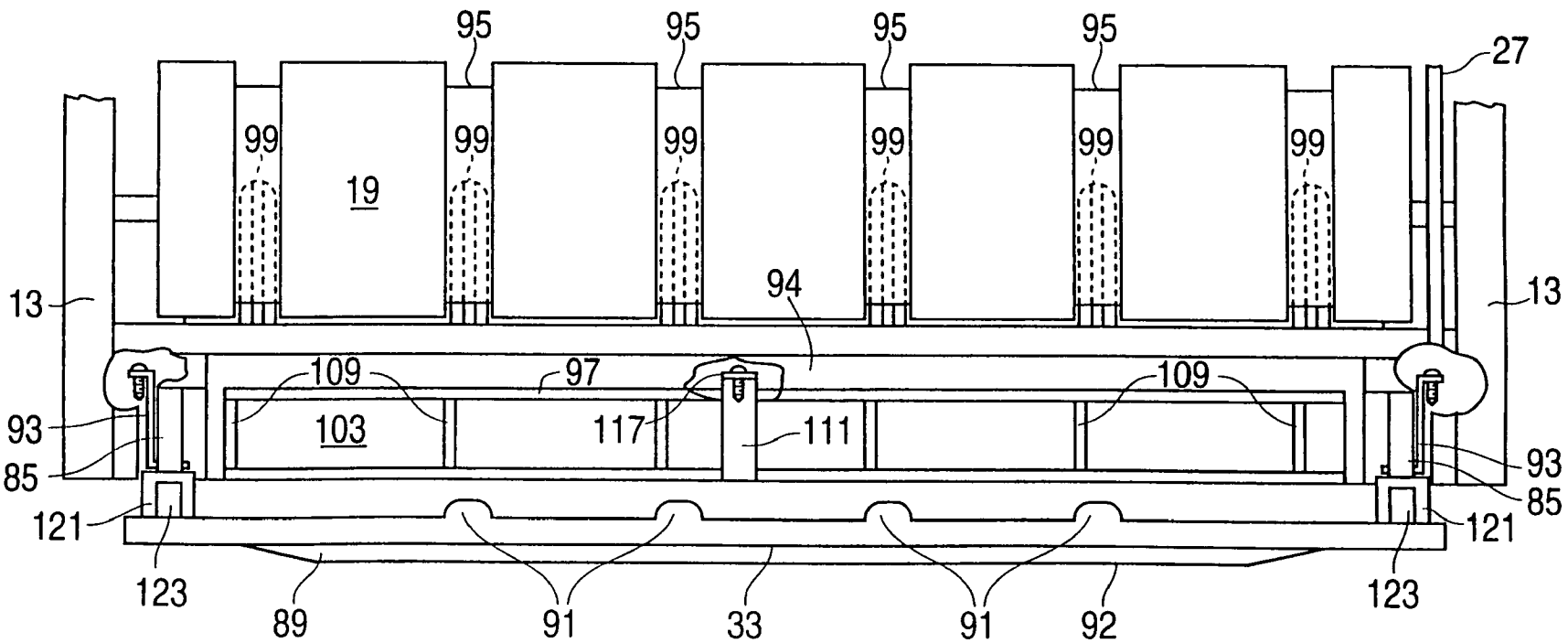
FIG. 9 is an enlarged partial top plan view like FIG. 8, but showing the transfer arm and movable front shield in respective open (loading) positions.

As best seen in FIGS. 3 and 9, rotatable transfer arm 33 includes a pair of spaced lever arms 85 pivoted on respective pivot pins 87 (see FIG. 3) protruding from opposite lateral sides of a stationary bracing 94 supported between side plates 13, in front of main feed roller 19. Bracing 94 provides on its inside surface (facing main feed roller 19) continuations of web material stripper bars 99 extending into feed roller grooves 95. A transfer bar 89 is attached to and extends the length of feed roller 19 between and slightly beyond arms 85, and four blunt transfer fingers 91 (angled upwardly in the open position shown in FIG. 9) are spaced along a leading edge of transfer bar 89. A strengthening rib 92 extends along a trailing edge of transfer bar 89.

Transfer arm 33 is biased towards the transfer position 33' (see FIG. 3) by a transfer spring 93 (see FIG. 9) mounted adjacent one or both of side plates 13 (both sides as shown), and pressing against an underside of one (or both) of spaced lever arms 85. As shown, springs 93 comprise wire spring arms mounted to stationary bracing 94 extending between side plates 13. A pair of 0.8 mm steel wire spring arms 93

(lacking coils) should suffice to provide a suitable small upward biasing force on lever arms 85. Alternatively, a spring arm with coils providing additional biasing force may be utilized. Spring 93 has a main arm portion which when bent creates the biasing spring force, a base leg portion extending in a first direction perpendicular to the main arm portion and terminating with a fixation eye, and a perpendicular arm-contacting portion at the opposite end of the main arm portion extending in a second direction opposite to the extending direction of the base leg portion.

Transfer fingers 91 correspond in position to four circumferential grooves 95 provided in main feed roller 19. As previously described, transfer arm 33 is restrained in a set position by the stop arm 27, and upon release moves forward into web transfer position 33' (see FIG. 3), which movement effects a transfer operation, as described below.

Web 39 from reserve roll R is prepositioned to extend downward in front of upper idler roller 29 and into a space defined between a stationary shield plate 97 attached to a front side of stationary bracing 94 (see FIGS. 3 and 9) and transfer arm 33 placed in the set position, adjacent to, or in light contact with, transfer fingers 91. Upon release of transfer arm 33, a leading end portion of reserve web 39 is pushed toward main feed roller 19, by transfer fingers 91. In the transfer position 33', transfer fingers 91 have forced contacted web portions of web 39 into or adjacent transfer feed roller grooves 95, and into contact with the outer surface of feed roller 19. Upon driving of main feed roller 19, i.e., normal dispensing by pulling on exposed web portion 15, a leading end portion of web 39 from reserve roll R is drawn into feed nip 37. Specifically, as a remaining end portion of web 17 is pulled-out, rotation of feed roller 19 simultaneously draws web 39 into nip 37. Thereafter, the web travels around the backside of feed roller 19, to about a 5:00 position, where the web is stripped-off the feed roller 19, by stripper bars 99 (see FIG. 9), and emerges from the dispensing slot adjacent exit roller 101, thereby completing the transfer of feed to the reserve roll R. Once significantly depleted, reserve roll R can be placed into receptacle 49 where it becomes working roll 35, and a new reserve roll R may be installed in the manner previously described.

Dispenser maintenance, i.e., removing a spent stub roll 35 from receptacle 49, relocating a partially depleted roll from between wing members 9 to receptacle 49, and installing a new reserve roll between wing member 9, is simplified by way of a movable shield 103 located in front of stationary shield plate 97, as best seen in FIGS. 1, 3, 8 and 9. As shown in FIG. 1, movable shield 103 is partially exposed through a laterally elongated port 105 formed in dispenser cover 1. Shield 103 is arc-shaped in profile, and presents a smooth arcuate face on the lower front of the dispenser during normal operation. The exposed leading web end 15 emerges from the dispenser between exit roller 101 and the lower edge of shield 103. As seen in FIGS. 3 and 9, the lower edge of shield 103 is hingedly connected to side plates 13 via a pair of pivot pins/holes 107, and the main arcuate panel of shield 103 is strengthened by spaced arcuate ribs 109 provided on its inside surface. Shield 103 is biased to rotate outwardly to an open position (counter-clockwise as viewed in FIG. 3) by a spring 111 (see FIG. 9). Spring 111 may be a flat leaf spring having an overall L-shape which presses against the inside of shield 103, between a central pair of support ribs 109. Spring 111 is mounted on stationary bracing 94 by a screw 117 extending through a short mounting tab, so that a perpendicular main arm portion extends upwardly in contact with the arcing inner contour of shield 103. Spring 111 may comprise an L-shaped base member providing the mounting tab, and a separate flat strip of spring metal secured thereto to provide the main arm portion. Other spring configurations, including an equivalently functioning single or double coil spring, could be substituted.

Figure 8:
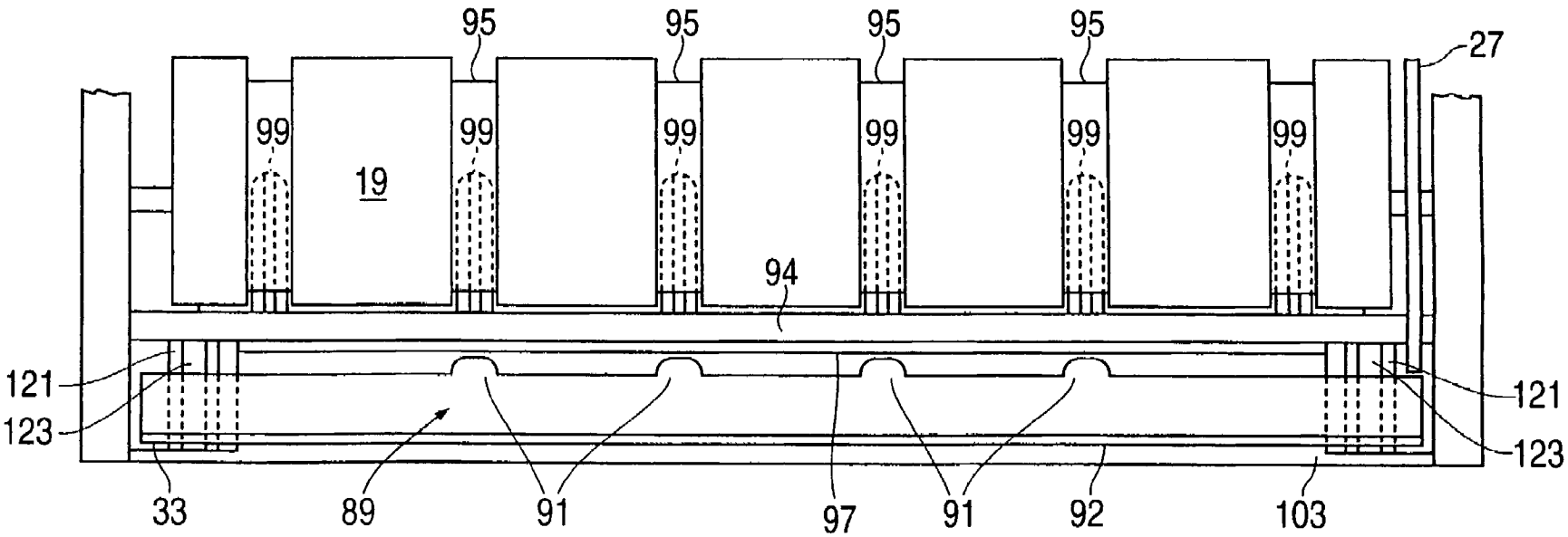
FIG. 8 is an enlarged partial top plan view of a front-end portion of the web transfer mechanism shown in FIG. 3, with structure removed to show clearly a transfer arm in a set position, and a movable front shield in a closed position.

As best seen in FIGS. 8 and 9, yoke-like arm guides 121 extend inwardly from the top edge of the main panel of shield 103, at respective spaced locations that correspond to arms 85 of transfer arm 33. Guides 121 form rectangular slots 123 surrounding and confining the movement of spaced arms 85. The arrangement provides a partial coupling of the transfer arms 33 to the movement of shield 103, as will be apparent from the following description of dispenser operation.

As cover port 105 is sized to be shorter in length than shield 103, movable shield 103 cannot pass therethrough and is thus retained (against the bias of spring 111) in the closed position shown in FIG. 8, so long as cover 1 is in its closed position. In a normal maintenance operation, a custodian seeking to install a new reserve roll R will unlock cover 1 and swing it open by gripping its top and rotating it downwardly about pivot point 3. At this point, any depleted roll core retained in receptacle 49 (on the floor formed by the bottom panel of cover 1) will roll forward by gravity within opened cover 1, thus presenting itself for easy removal. Such action occurs by virtue of the open bottom of receptacle 49, and the inclined orientation of cover 1 in the open position.

Additionally, as cover 1 is opened, shield 103 is released to rotate counterclockwise to the open position shown in FIG. 9 (and labeled 103' in FIG. 3). As shield 103 rotates into open position 103', the inside end surfaces of slots 123 of arm guides 121 contact the opposing edges of lever arms 85. Spring 111 biases movable shield 103 outwardly, and overcomes the relatively weaker opposing bias of springs 93 acting on arms 85. Thus, as shield 103 is pushed to its open position, arm guides 121 pull arms 85 forwardly to pivot transfer bar 33 outwardly, with the inside ends of slots 123 sliding upwardly along arms 85. By this motion, transfer bar 33 is retracted into the open (loading) position shown in FIG. 9 (and labeled 33" in FIG. 3) spaced a maximum distance away from feed nip 37.

As thus described, in one smooth motion, the opening of cover 1 allows movable shield 103 to open, and transfer arm 33 to retract away from the feed nip, thereby presenting a large, easily accessible opening for pre-transfer placement and retention of the leading end portion of a new reserve roll R. Specifically, once a new reserve roll R is mounted between wing members 9 and a leading web end portion is pulled free from the roll, setting of the dispenser for a subsequent transfer is a simple matter of passing the leading web end portion over idler roller 29 and placing the same between stationary plate 97 and pivotable transfer arm 33 (retracted to position 33"). The dispenser is then returned to a normal dispensing condition by simply swinging cover member 1 closed. Closure of cover member 1 automatically locks shield 103 in its closed position, and returns transfer arm 33 to its set position (see FIGS. 3 and 8), retained by stop arm 27, until a release thereof by sensor plate 25 upon depletion of the stub roll.

The components of the inventive web transfer mechanism may be manufactured using known materials and manufacturing techniques. For example, durable lightweight thermoplastic material, e.g., ABS, and injection molding, can be used to form the dispenser housing and chassis components, as well as the sensor plate 25, stop arm 27, transfer arm 85, and movable shield 103. Preferably, transfer arm 85 has glass fiber (e.g., 30%) added to the thermoplastic resin to increase the stiffness thereof. As previously indicated, main feed roller 19 preferably has a construction as described in Rasmussen U.S. Pat. No. 4,712,461 (and incorporated into the Georgia-Pacific P-12 dispenser). The remaining rollers may comprise molded plastic hubs on mounted circular steel shafts. Various other suitable materials, configurations and manufacturing methods will be apparent to those skilled in the art.

The present invention has been described in terms of preferred and exemplary embodiments thereof. Numerous other embodiments, modifications and variations within the scope and spirit of the appended claims will occur to persons of ordinary skill in the art from a review of this disclosure.

The invention claimed is:

1. A web transfer mechanism for providing, in a flexible sheet material dispenser, automatic transfer of web feed from a working roll to a reserve roll, comprising:

a main feed roller and a second roller forming a feed nip for receiving therethrough a sheet material web;

a transfer arm mounted adjacent to the main feed roller, the transfer arm being movable into a transfer position, wherein movement of the transfer arm into the transfer position is operative to drive a leading end portion of sheet material web extending from the reserve roll into a vicinity of the feed nip such that upon driving of the main feed roller the sheet material web from the reserve roll is carried through the feed nip;

a dispenser cover member; and a movable shield member, the shield member being partially exposed through a port formed in the dispenser cover member, the shield member being biased to move into an open position automatically when the cover member is moved to an open position, the shield member presenting, when in its open position, a space for placement and retention of the leading end portion of sheet material web between the transfer arm and the main feed roller, to thereby pre-set the leading end portion for a subsequent transfer of feed thereto, the movable shield member being operably connected with the transfer arm such that movement of the movable shield member to its open position causes movement of the transfer arm to a retracted position spaced from the transfer position.

2. The web transfer mechanism of claim 1, wherein movement of the dispenser cover member into a closed position automatically moves the shield member into a closed position.

3. The web transfer mechanism of claim 2, wherein the movement of the shield member into the closed position causes movement of the transfer arm to a set position between the retracted position and the transfer position.

4. The web transfer mechanism of claim 1, wherein the shield member is arc-shaped in profile.

5. The web transfer mechanism of claim 4, wherein the shield member comprises arcuate ribs on its inside surface.

* * * * *